US005836439A

United States Patent [19]

Coyette

[11] Patent Number: 5,836,439

[45] Date of Patent: Nov. 17, 1998

[54] DEVICE FOR THE ROTATION OF SHEETS ON A ROLLER CONVEYOR

[75] Inventor: Luc Coyette, Cortil Noirmont, Belgium

[73] Assignee: C. P. Bourg S.A., Belgium

[21] Appl. No.: 815,065

[22] Filed: Mar. 11, 1997

[30] Foreign Application Priority Data

Mar. 13, 1996 [FR] France ..... 96 03164

[51] Int. Cl.[6] ..... B65G 47/24

[52] U.S. Cl. ..... 198/415; 198/411

[58] Field of Search ..... 198/411, 415; 271/184, 225

[56] References Cited

U.S. PATENT DOCUMENTS

| | | | |
|---|---|---|---|
| 3,758,104 | 9/1973 | Daily | 198/415 X |
| 4,696,386 | 9/1987 | Lem | 198/415 X |
| 4,955,965 | 9/1990 | Mandel | 271/225 |
| 5,145,049 | 9/1992 | McCluskin | 198/415 X |

FOREIGN PATENT DOCUMENTS

| | | |
|---|---|---|
| 0 302 667 | 2/1989 | European Pat. Off. . |
| 0 512 827 | 11/1992 | European Pat. Off. . |
| 2 112 729 | 7/1983 | United Kingdom . |

*Primary Examiner*—James R. Bidwell
*Attorney, Agent, or Firm*—Sixbey, Friedman, Leedom & Ferguson, P.C.; Gerald J. Ferguson, Jr.; Tim L. Brackett, Jr.

[57] ABSTRACT

To turn through 90° sheets passing at a rapid rate over a roller conveyor in a horizontal plane, a device is proposed which comprises a pair of rollers entrained in rotation at different speeds and spaced apart from each other and from a longitudinal guide on the conveyor transversely with respect thereto. Each of the rollers has its rotation axis inclined with respect to the normal on this guide, by a specified angle which is greater for the roller which is closest to the guide and the rotation speed of which is the smaller. Each of the rollers has its periphery in contact with a support ball or with the lower face of a sheet during its passage, substantially in said transport plane.

13 Claims, 4 Drawing Sheets

DEVICE FOR THE ROTATION OF SHEETS ON A ROLLER CONVEYOR

TECHNICAL FIELD

The present invention relates to a device for the rotation of sheets on a roller conveyor which defines a transport plane and is provided with a longitudinal guide rail for the alignment of the sheets.

BACKGROUND OF THE INVENTION

Sheets leaving at a rapid rate a reproduction machine such as a printer can present themselves in one or other of two perpendicular orientations. With the aim of finishing as a booklet, section or brochure, the sheets are brought by a conveyor to a finishing machine. If the finishing machine is provided for processing the sheets in one of the two possible orientations, and if the sheets brought by the conveyor present themselves in the other of the two orientations, they must be turned in their plane by an angle of 90°.

The present invention offers a device for the rotation of sheets capable of turning them in their plane by an angle of 90° without interruption or slowing down of their movement on the conveyor and without the risk of damage.

SUMMARY OF THE INVENTION

According to the invention, the device for the rotation of sheets comprises a pair of rollers entrained in rotation at different speeds and spaced apart from each other and from said guide rail transversely with respect thereto, each of said rollers having its axis of rotation inclined with respect to the normal on said guide rail by a determined angle which is greater for the roller which is closer to said stop and the speed of rotation of which is the smallest, and each of said rollers having its periphery in contact with a rotary support element or with the lower face of a sheet as it passes, substantially in said transporting plane.

Thus, by the differential speed of the two rollers, the sheets passing over them continue their path on the rollers of the conveyor whilst being braked in a controlled manner in their region close to the guide rail, so that they are turned as they pass over the rollers. Simultaneously, by the inclination of the rollers with respect to the longitudinal direction on the conveyor, the sheets are retracted from the guide rail. As the edge of each sheet is therefore distanced from the guide rail as it passes over the rollers, the anterior corner of the sheet close to this stop does not risk striking against the latter, and any risk of damage to the sheet is avoided.

Preferably, a conveyor with rotary cylinders is used which automatically carries out a correction of a fault in register of the sheets which are received.

This correction results from an inclination of the cylinders of the conveyor with respect to the normal on the guide rail in a direction such that the sheets are displaced towards this rail when they pass over the rollers. The sheets therefore arrive perfectly aligned in front of the two rollers and are then distanced from the guide rail during the rotation phase. However, when the sheets leave the contact zone with the rollers they are moved again in the direction of the longitudinal rail and are correctly aligned when they leave the conveyor after rotation of 90°.

In a preferred embodiment of the device, the ratio of rotation speeds of the rollers is 1:2, and the speed of rotation of the roller which is furthest away from the stop is determined so as to present parallel to the guide rail a component which is equal to that of the rotary cylinders of the conveyor. Thus, the transporting of the sheets on the conveyor is not disturbed by the rotation phase. The synchronisation of rotation of the cylinders with that of the rollers is automatically ensured by a common drive mechanism.

Other details and features of the invention will emerge from the following decription of a preferred embodiment of the device

DETAILED DESCRIPTION OF THE PREFERRED EMBODIMENT

Figure 1:
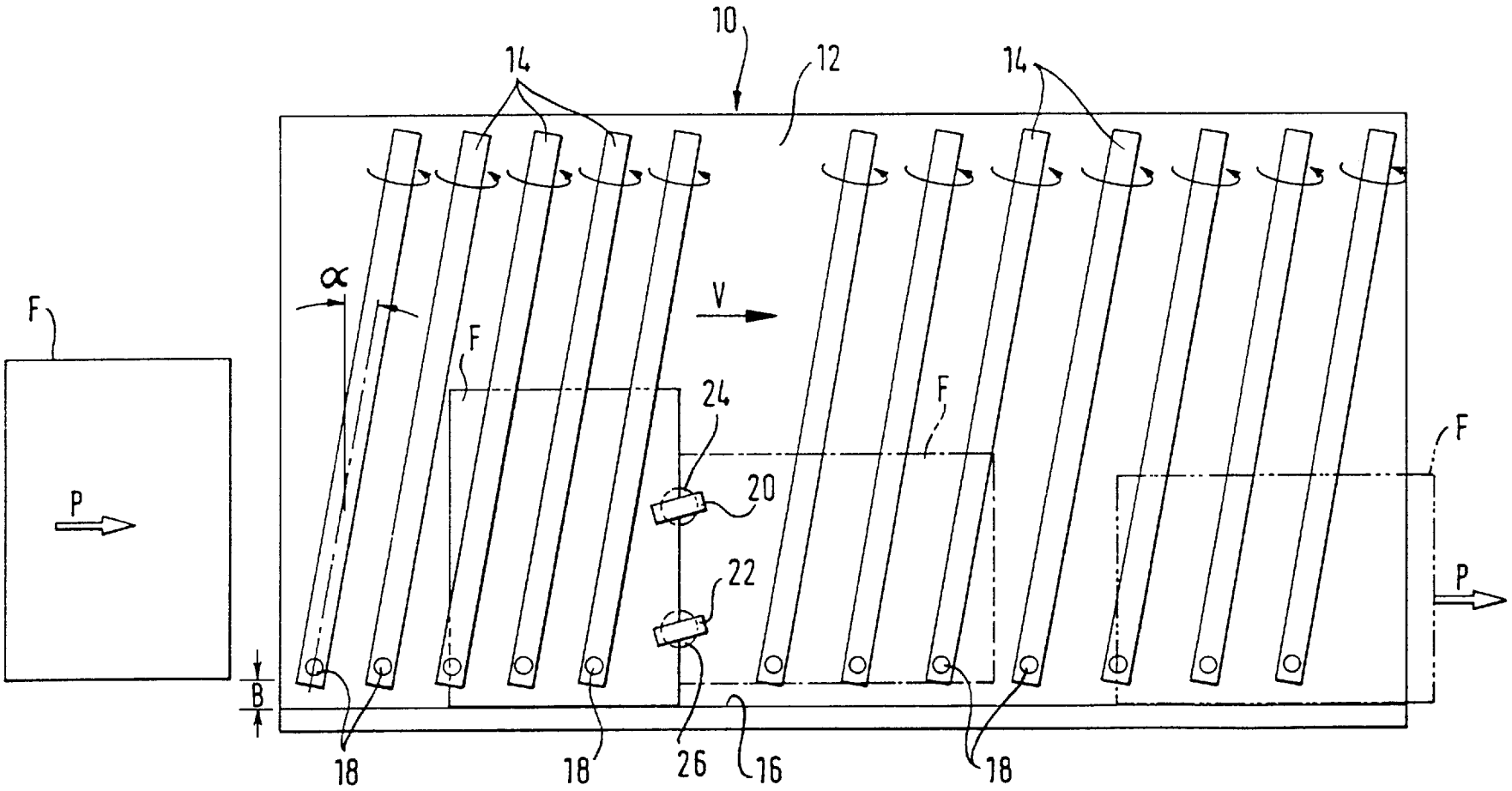
FIG. 1 is a diagrammatic plan view of a roller conveyor in which there is integrated a device for the rotation of sheets.

In the embodiment shown, a device for the rotation of sheets, designated overall by 10, is integrated in a horizontal conveyor 12 provided with a series of parallel cylinders 14. On one longitudinal side, the conveyor 12 has a guide rail 16 for the alignment of the sheets. The cylinders 14 are inclined with respect to the normal to the guide rail 16 by an angle $\alpha$ which is in the order of 10°, in a direction such that the sheets F passing over the cylinders 14 are permanently urged in the direction of the rail 16. The cylinders 14 which are entrained in rotation by a mechanism which will be described hereinbelow with reference to FIGS. 3 and 4, each cooperate with a support ball 18 mounted in free rotation in a cylindrical guiding element perpendicular to each roller end close to the rail 16.

The rotation device 10 is essentially constituted by a pair of rollers 20, 22 spaced apart from each other and from the guide rail 16 perpendicularly thereto. The roller 20 further from the rail 16 than the roller 22 is entrained in rotation at twice the speed of the roller 22. As can be seen more clearly from FIG. 2, the axes of rotation of the rollers 20, 22 are inclined with respect to the normal to the rail 16 by an angle $\beta$ and $\gamma$ respectively, greater for the roller 22 which is closer to the rail 16. In fact, the inclination of the rotation axes of the rollers 20, 22 is such that these axes intersect in an imaginary centre of rotation C of the sheets.

Figure 2:
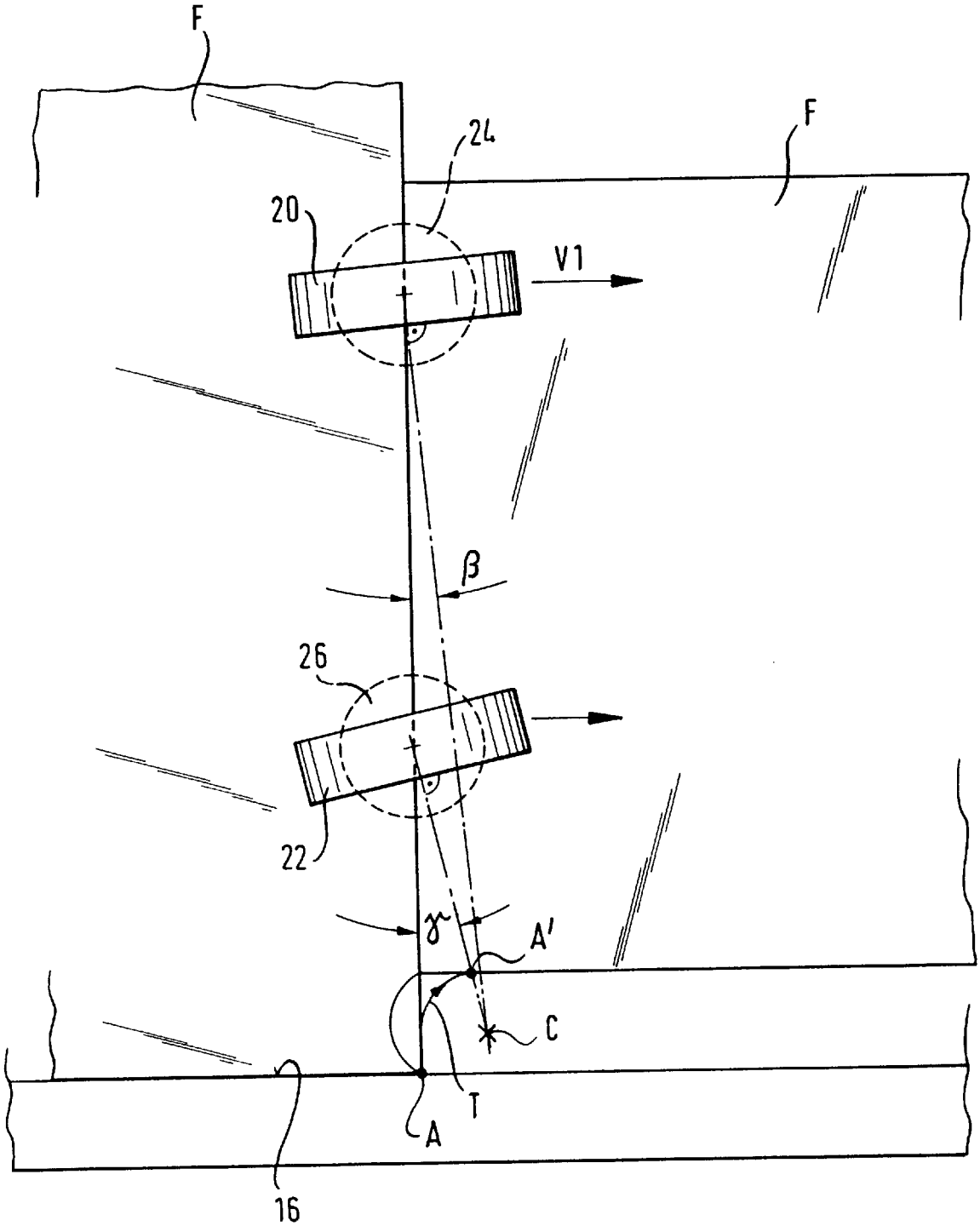
FIG. 2 is a diagrammatic plan view of the rotation device on a larger scale.
Figure 5:
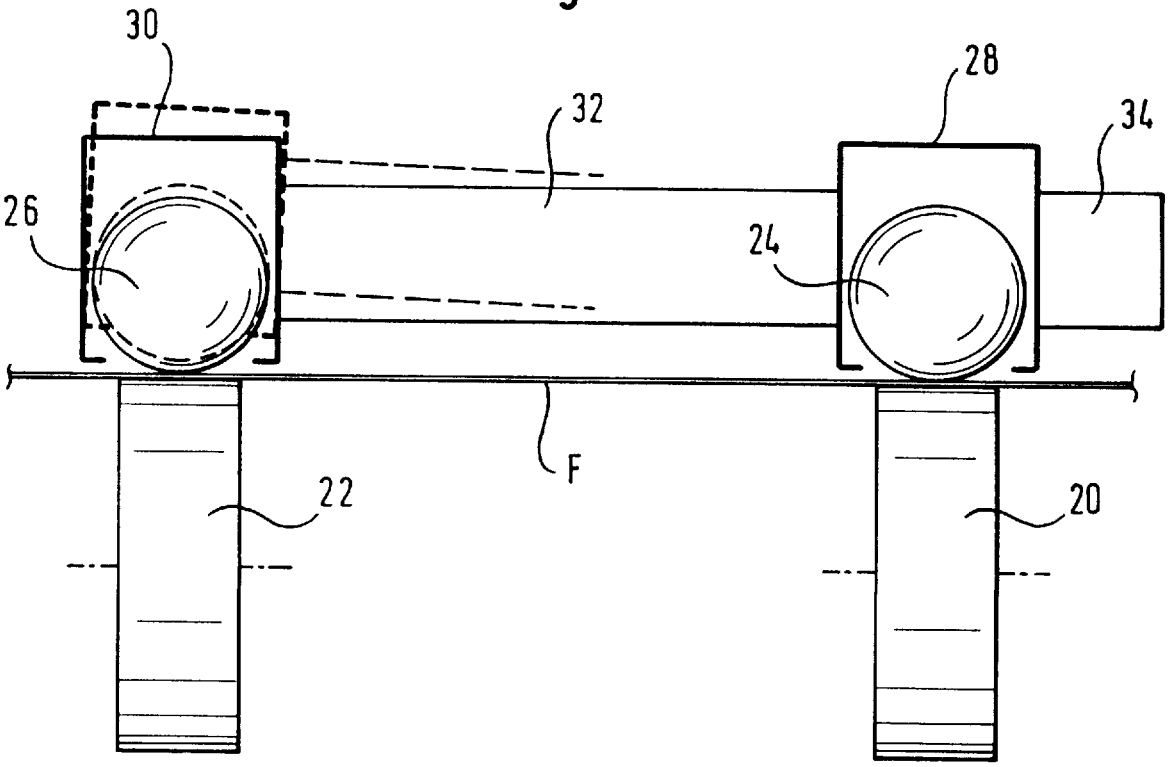
FIG. 5 is a diagrammatic view in elevation of the rotation device.

As can be seen from FIGS. 2 and 5, a support element in the form of a ball 24, 26 is associated with the rollers 20, 22 respectively. The balls 24,26 are mounted in free rotation in the cylindrical guiding elements 28, 30 which are fixed on a pivoting arm 32, the pivot axis 34 of which is situated at one end of the arm 32. The guides 28, 30 each have an opening in their base allowing the surface of the balls 24, 26 to pass so that they enter into contact with the periphery of the associated roller 20, 22. The contact between the rollers 20, 22 and the balls 24, 26 is carried out at the level of the transport plane P of the sheets, defined by the upper face of the cylinders 14.

Figure 3:
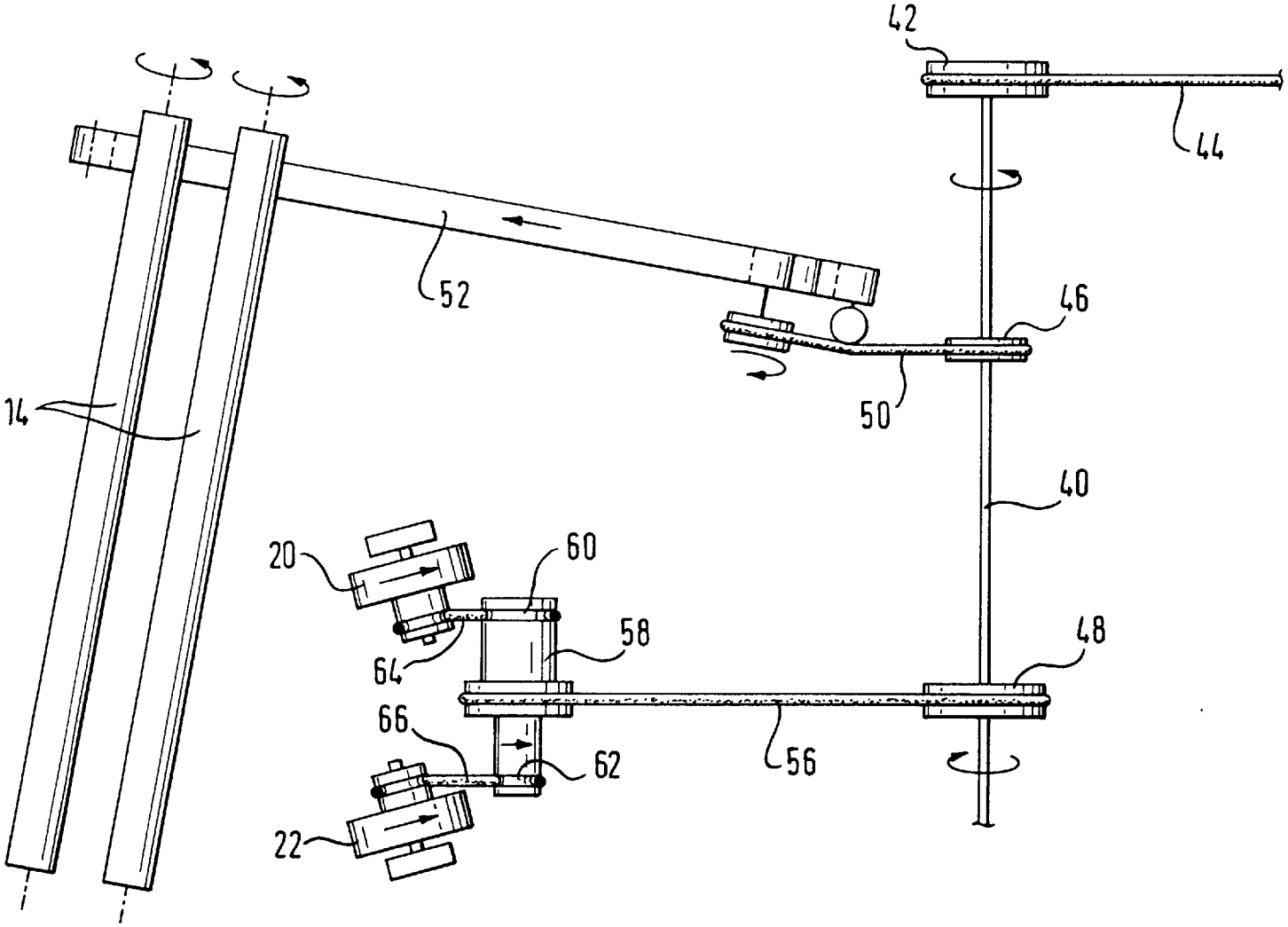
FIG. 3 is a diagrammatic plan view of a drive mechanism.
Figure 4:
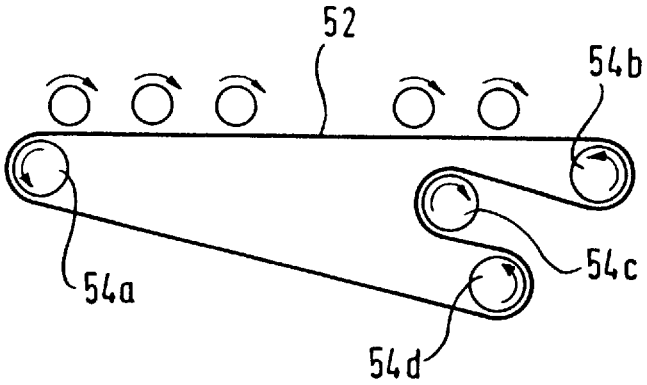
FIG. 4 is a view in elevation of the drive mechanism.

As can be seen from FIGS. 3 and 4, a common drive mechanism is provided for the cylinders 14 and the rollers 20, 22. This mechanism comprises a distribution shaft 40 carrying at one of its ends a pulley 42 entrained in rotation by means of a belt 44 from a source not illustrated. This source may be an entrainment motor of the conveyor 12 or an intake of force on any machine with which the conveyor is associated, for example a finishing machine. The distribution shaft 40 carries two other pulleys 46, 48, the first of which controls, by means of a belt 50, the movement of a wide belt 52 drawn over a roller/tightener system 54 a,b,c and d and engaging with friction the lower face of the cylinders 14. The other pulley 48 controls, via a belt 56, the rotation of an entrainment shaft 58 which has, at each of its ends, a groove 60, 62 in which a belt 64 and 66, respectively, is engaged. The diameter of the groove 60 is twice that of the groove 62. Finally, as can be seen from FIG. 3, the rollers 20 and 22 are entrained in rotation by means of the belts 64 and 66, respectively.

In operation, a sheet f presents itself at the entry of the conveyor 12, typically transversely to the guide rail 16 and with a staggering with respect thereto. The sheet f is received at a relatively high speed in the order of one metre per second or more. As soon as the sheet f is engaged by the cylinders 14 it is subjected permanently to an urging force towards the guide rail 16 due to the inclination of the cylinders. Before arriving at the rollers 20, 22, the sheet is therefore situated correctly aligned with respect to the guide rail 16.

When it is engaged between the rollers 20, 22 and the balls 24, 26, the sheet commences a complex movement of translation and rotation. This movement is due to the differential speed of the rollers 20, 22 and to their different inclination. The path of the sheet is better understood if one considers firstly the path of the interior corner of the sheet close to the rail 16. This corner, A in FIG. 2, therefore moves over a path T moving away from the rail 16 by a value approximately twice the longitudinal path covered at the same time, to arrive at a point A' of FIG. 2. Simultaneously, the sheet is turned by an angle of 90° so that it now presents itself in a longitudinal direction on the conveyor 12. It can therefore be seen that during the rotation of the sheet it is sufficiently spaced from the rail 16 to avoid any damage to its edge or to its corners.

As soon as the sheet has passed over the rollers 20, 22, it is subjected again to urging towards the stop 16, due to the inclination of the cylinders 14. As can be seen in FIG. 1, the sheets leave the conveyor 12 correctly aligned with respect to the rail 16, but turned by an angle of 90°.

To pass the sheets without rotation on the conveyor 12, it suffices to lift the ball 26 associated with the roller 22, by pivoting the arm 32. The sheet therefore remains held between the roller 20 and the ball 24, so that it is slightly distanced from the rail 16. This effect is in no way intrusive since the sheet is immediately brought against the rail 16 after passing over the rollers 20, 22.

Alternatively, the two balls 24, 26 are lifted to selectively allow sheets to pass without rotation.

The device described has a secure and reliable operation despite its great simplicity. It does not require a sheet detector or adjustment to the format of the sheets. The rotation is even ensured when the sheets are not separated but stacked so that several sheets pass simultaneously over the rollers 20, 22.

The choice of the imaginary centre of rotation C is determined by the differential inclination of the rollers 20, 22. By the choice of this centre, the value of disengagement of the sheets with respect to the rail 16 is easily determined. Thus, according to needs, even quite a large staggering can be produced of the alignment of the sheets downstream of the rollers 20, 22.

I claim:

1. A device for rotating sheets on a sheet conveyor, said conveyor comprising a plurality of rotating cylinders defining a transport plane (P) and a lateral guide rail which extends in a longitudinal direction of said conveyor, and further comprising a pair of rollers entrained in rotation at mutually different speeds and spaced apart from each other and from said guide rail transversely to said longitudinal direction, each of said rollers having an axis inclined with respect to a direction normal to said longitudinal direction by a determined angle which is greater for one of said rollers which is closer to said guide rail and has a lower speed of rotation, and each of said rollers having a periphery opposed to an associated rotary support element substantially in said transport plane, wherein said rollers have rotation axes which intersect each other substantially at an imaginary centre of rotation of the sheets.

2. A device for rotating sheets on a sheet conveyor, said conveyor comprising a plurality of rotating cylinders defining a transport plane (P) and a lateral guide rail which extends in a longitudinal direction of said conveyor, and further comprising a pair of rollers entrained in rotation at mutually different speeds and spaced apart from each other and from said guide rail transversely to said longitudinal direction, each of said rollers having an axis inclined with respect to a direction normal to said longitudinal direction by a determined angle which is greater for one of said rollers which is closer to said guide rail and has a lower speed of rotation, and each of said rollers having a periphery opposed to an associated rotary support element substantially in said transport plane, wherein said rollers have rotation axes inclined in a sense so that sheets passing between said rollers and said rotary support element tend to retract from said guide rail.

3. The device according to claim 2, wherein said cylinders are inclined with respect to a direction normal to said guide rail so as to align sheets along said guide rail.

4. The device according to claim 2, wherein said rollers have a ratio of speeds of rotation which is 1:2.

5. The device according to claim 2, wherein said rollers have rotation axes which intersect each other substantially at an imaginary centre of rotation of the sheets.

6. The device according to claim 2, wherein one of said rollers which is furthest from said guide rail has a speed of rotation which is determined so as to present parallel to said guide rail a component which is substantially equal to a corresponding component of speed of rotation of said cylinders.

7. The device according to claim 2, wherein each rotary support element is constituted by a ball mounted in free rotation in a vertical cylindrical guide of said conveyor.

8. The device according to claim 2, wherein one of said rotary support elements which is closest to said guide rail can be selectively raised.

9. The device according to claim 2, wherein each of said cylinders has an associated support ball mounted in free rotation in the vicinity of said guide rail.

10. The device according to claim 2, wherein said cylinders and said rollers are entrained in rotation in a synchronous manner by a common drive mechanism.

11. A device for rotating sheets on a sheet conveyor, said conveyor comprising a plurality of rotating cylinders defining a transport plane (P) and a lateral guide rail which extends in a longitudinal direction of said conveyor, and further comprising a pair of rollers entrained in rotation at mutually different speeds and spaced apart from each other and from said guide rail transversely to said longitudinal direction, each of said rollers having an axis inclined with respect to a direction normal to said longitudinal direction by a determined angle which is greater for one of said rollers which is closer to said guide rail and has a lower speed of rotation, and each of said rollers having a periphery opposed to an associated rotary support element substantially in said transport plane, wherein each rotary support element is constituted by a ball mounted in free rotation in a vertical cylindrical guide of said conveyor.

12. A device for rotating sheets on a sheet conveyor, said conveyor comprising a plurality of rotating cylinders defining a transport plane (P) and a lateral guide rail which extends in a longitudinal direction of said conveyor, and further comprising a pair of rollers entrained in rotation at mutually different speeds and spaced apart from each other and from said guide rail transversely to said longitudinal direction, each of said rollers having an axis inclined with respect to a direction normal to said longitudinal direction by a determined angle which is greater for one of said rollers which is closer to said guide rail and has a lower speed of rotation, and each of said rollers having a periphery opposed to an associated rotary support element substantially in said transport plane, wherein one of said rotary support elements which is closest to said guide rail can be selectively raised.

13. A device for rotating sheets on a sheet conveyor, said conveyor comprising a plurality of rotating cylinders defining a transport plane (P) and a lateral guide rail which extends in a longitudinal direction of said conveyor, and further comprising a pair of rollers entrained in rotation at mutually different speeds and spaced apart from each other and from said guide rail transversely to said longitudinal direction, each of said rollers having an axis inclined with respect to a direction normal to said longitudinal direction by a determined angle which is greater for one of said rollers which is closer to said guide rail and has a lower speed of rotation, and each of said rollers having a periphery opposed to an associated rotary support element substantially in said transport plane, wherein each of said cylinders has an associated support ball mounted in free rotation in the vicinity of said guide rail.

* * * * *